US009636598B2

(12) United States Patent
Cai

(10) Patent No.: US 9,636,598 B2
(45) Date of Patent: May 2, 2017

(54) SENSING CONTROL SYSTEM FOR ELECTRIC TOY

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Gangzhou Alpha Culture Communications Co., Ltd. (CN)

( * ) Notice: Subject to any disclaimer, the term of this patent is extended or adjusted under 35 U.S.C. 154(b) by 0 days.

(21) Appl. No.: 14/440,304

(22) PCT Filed: Nov. 7, 2014

(86) PCT No.: PCT/CN2014/090535
§ 371 (c)(1),
(2) Date: May 1, 2015

(87) PCT Pub. No.: WO2015/109879
PCT Pub. Date: Jul. 30, 2015

(65) Prior Publication Data

US 2016/0045836 A1 Feb. 18, 2016

(30) Foreign Application Priority Data

Jan. 22, 2014 (CN) ..... 2014 1 0029070

(51) Int. Cl.
*A63H 30/00* (2006.01)
*A63H 17/32* (2006.01)
(Continued)

(52) U.S. Cl.
CPC ..... *A63H 29/24* (2013.01); *A63H 17/32* (2013.01); *A63H 29/22* (2013.01); *A63H 30/00* (2013.01);
(Continued)

(58) Field of Classification Search
CPC ..... A63H 17/00; A63H 17/32; A63H 29/00; A63H 29/22; A63H 30/00; A63H 30/02; A63H 2200/00
See application file for complete search history.

(56) References Cited

U.S. PATENT DOCUMENTS 4,479,329 A * 10/1984 Fraden ..... A63H 3/00 446/175
7,442,107 B1 * 10/2008 Ueda ..... A63H 11/20 446/175
(Continued)

FOREIGN PATENT DOCUMENTS

CN 85204392 U 11/1986
CN 101168101 A 4/2008
(Continued)

OTHER PUBLICATIONS

Singapore Written Opinion for Application No. 112015038630 dated Dec. 7, 2015.
(Continued)

*Primary Examiner* — Gene Kim
*Assistant Examiner* — Alyssa Hylinski
(74) *Attorney, Agent, or Firm* — Lerner, David, Littenberg, Krumholz & Mentlik, LLP

(57) ABSTRACT

The present invention provides a sensing control system for an electric toy, characterized in that it comprises a signal detection module for receiving an external sensing and then generating a sensing signal; a calculation and control module for receiving the sensing signal and counting a number
(Continued)

of the sensing signal, and then sending out different control signals corresponding to different numbers of the sensing signals; and an electric driving module for receiving the control signal and then sending a driving signal to the electric toy, so as to control the electric toy to work. Therefore, according to different numbers of sensing signals, the electric toy is able to perform different actions or speed changes of the same action. In this way, the toy equipped with the sensing control system of the present invention can go beyond the limitation of a remote control, and thus becomes suitable as a toy for children of different ages. In addition, it makes a toy gain advantages of becoming more user friendly, more interactive, more interesting, and thus would become many children's favorite.

7 Claims, 2 Drawing Sheets

(51) Int. Cl.

| | |
|---|---|
| ***A63H 29/24*** | (2006.01) |
| ***A63H 29/22*** | (2006.01) |
| ***A63H 33/26*** | (2006.01) |
| ***A63H 30/04*** | (2006.01) |

(52) U.S. Cl.
CPC ..... *A63H 30/04* (2013.01); *A63H 33/26* (2013.01); *A63H 2200/00* (2013.01)

(56) References Cited

U.S. PATENT DOCUMENTS

| | | | | |
|---|---|---|---|---|
| 2002/0016128 | A1* | 2/2002 | Saito | A63H 3/28 446/268 |
| 2002/0081937 | A1* | 6/2002 | Yamada | A63H 3/48 446/175 |
| 2006/0046606 | A1* | 3/2006 | Martin | A63H 30/00 446/166 |
| 2006/0099882 | A1 | 5/2006 | Eckerman et al. | |
| 2010/0198406 | A1* | 8/2010 | Lin | A63H 30/04 700/258 |
| 2013/0241819 | A1* | 9/2013 | Yamashita | G06F 3/017 345/156 |
| 2015/0032258 | A1* | 1/2015 | Passot | B25J 9/1656 700/250 |
| 2015/0091694 | A1* | 4/2015 | Degtyarev | A63H 17/36 340/5.51 |
| 2016/0151716 | A1* | 6/2016 | Nagai | A63H 29/22 446/237 |

FOREIGN PATENT DOCUMENTS

| | | | |
|---|---|---|---|
| CN | 201658845 | U | 12/2010 |
| CN | 102614669 | A | 8/2012 |
| CN | 202410166 | U | 9/2012 |
| CN | 202526899 | U | 11/2012 |
| CN | 103785180 | A | 5/2014 |
| JP | S5886195 | U | 6/1983 |
| JP | H0453581 | A | 2/1992 |
| JP | 2005103000 | A | 4/2005 |
| JP | 2008279177 | A | 11/2008 |
| JP | 2013171838 | A | 9/2013 |

OTHER PUBLICATIONS

International Search Report for Application No. PCT/CN2014/090535 dated Feb. 15, 2015.

Eric Singer: "CMU Electronic Media Studio 1-9 II, Fall 2011, Section D >Assignment 9a due Nov. 2016", Nov. 10, 2011 (Nov. 10, 2011), XP055305284, Retrieved from the Internet: URL:http://cmuems.com/2011/d/?cat=20 [retrieved on Sep. 23, 2016].

Extended European Search Report for Application No. PCT/CN2014/090535 dated Oct. 5, 2016.

* cited by examiner

SENSING CONTROL SYSTEM FOR ELECTRIC TOY

CROSS-REFERENCE TO RELATED APPLICATIONS

The present application is a national phase entry under 35 U.S.C. §371 of International Application No. PCT/CN2014/090535 filed Nov. 7, 2014 which claims priority from Chinese application 201410029070.X filed Jan. 22, 2014, all of which are incorporated herein by reference.

FIELD OF THE INVENTION

The present invention relates to a sensing control system. More specifically, it is a sensing control system for an electric toy.

BACKGROUND

Regarding the currently available electric toys, one type of them is controlled by a mechanical switch or button. Through turning on a mechanical switch or button provided on the body of an electric toy, the toy accordingly makes certain corresponding actions, which is driven by electric power. Nevertheless, the action of this type of electric toys cannot be controlled by a user. That is to say, after the mechanical switch or button being turned on, the electric driving device of the toy can only operate based on the parameters set in the production; in other words, these parameters are fixed and thus cannot be changed or modified. As a result, the action of the toy cannot be changed. In addition, there is another type of electric toy that can be controlled with a remote control. Through the remote control, the electric toy's action can be controlled. That is to say, by virtue of a remote control, a user can change or modify the action parameters of the toy, which leads to corresponding changes of the toy's action. However, this type of toy is significantly dependent on its remote control. In the case that its remote control is damaged, the toy would no longer function. Further, it could be a challenge for a child at very young age to control an electric toy's action through a remote control. Moreover, there is another type of electric toys that can be control through its sensing function, such as the non-contact sensing, for example, infrared sensing, and the contact sensing, for example, slot card sensing. Nevertheless, as for the currently available sensing controlled operation, their functions are actually equivalent to that of the above mentioned switch or button. That is to say, upon receiving a sensing signal, the toy can only make one corresponding action. As a result, this type of toy is not able to accomplish action changes through those sensing controls as well.

SUMMARY OF DISCLOSURE

To address the technical problem in the existing technology described above, one aim of the present invention is to provide a sensing control system for an electric toy, which is able to control the toy's action change by virtue of the number of frequency or sensing signals.

In order to achieve the foregoing aim, the present invention employs the technical solution as follows: a sensing control system for an electric toy, characterized by comprising:

a signal detection module for receiving an external sensing and then generating a sensing signal;

a calculation and control module for receiving the sensing signal and counting a number of the sensing signal and then sending out different control signals corresponding to different numbers of the sensing signals; and an electric driving module for receiving the control signal, and then sending a driving signal to the electric toy, so as to control the electric toy to work.

In which, the signal detection module comprises a non-contact sensing circuit, the non-contact sensing circuit is provided with a sensing receiver, the sensing receiver tracks and senses an action of a user in a real time manner, with respect to each action made by the user, the sensing receiver outputs one sensing signal and sends out the sensing signal to the calculation and control module.

In the present invention, the non-contact sensing circuit is selected from the group consisting of photo-sensitive sensing circuit, magnetic sensing circuit, thermal sensing circuit and sound sensing circuit.

In addition, in order to count the number or frequency of the sensing event, the calculation and control module comprises a control chip, the control chip is able to record the number of sensing signal sent out from the signal detection module in a continuous time period, and according to the recorded number of sensing signal to further send out a control signal to the electric driving module, wherein the control signal is corresponding to the recorded number of sensing signal.

Moreover, in order to identify the number of sensing and accordingly send out a corresponding control signal, the control chip has been stored with a plurality sets of control signals, wherein each set of control signal is corresponding to a range of the number, in the case that the above mentioned recorded number is not within any one of the ranges of the number, no signal is sent out; while in the case that the recorded number is within one of the ranges of the number, send out the control signal that is corresponding to the range of the number within which the recorded number is.

The sensing control system of the present invention can be applied in a wide variety of different electric toys. In this regard, the disclosed electric driving module can be selected from the group consisting of motor driving module, light driving module, sound driving module, electromagnet driving module and a combination of two or more of the foregoing.

More specifically, in the case the electric driving module is a motor driving module comprising a motor and the calculation and control module is provided with a single chip microcomputer (SCM), the single chip microcomputer (SCM) would be stored with the control signals as follows: when a range of the number is $N_1$, the motor runs at a speed of $S_1$ for $T_1$ seconds; when a range of the number is $N_2$, the motor runs at a speed of $S_2$ for $T_2$ seconds; and when a range of the number is $N_3$, the motor runs at a speed of $S_3$ for $T_3$ seconds; and so forth, when a range of the number is $N_m$, the motor runs at a speed of $S_m$ for $T_m$ seconds; when a range of the number is $N_2$, in which $N_1<N_2<N_3<N_m$, $S_1<S_2<S_3<S_m$, and $T_1<T_2<T_3<T_m$. On the other hand, the signal detection module is a photo-sensitive sensing module that comprises a phototransistor, the phototransistor is arranged on an upper surface of the electric toy, when a user waves his or her hand above the electric toy, the phototransistor receives a sensing and accordingly sends out a sensing signal to the calculation and control module, in the case that the user waves his or her hand for X times in a continuous time period and with a time interval between two consecutive waving actions no longer than 1 second, 1 second after the termination of the waving action by the user, the single chip microcomputer (SCM) counts the number of the received sensing signal and reaches a counting number X, and then respectively compares this number X with $N_1$, $N_2$, $N_3$ . . . $N_m$, if X is smaller than $N_1$, no signal is sent out, if X is within one of $N_2$, $N_3$ . . . $N_m$, the control signal corresponding to the range of the number within which X is sent out to the electric driving module, which further drives the motor to run according to the specified running speed and the specified running time corresponding to that control signal.

Furthermore, the signal detection model of the present invention may comprise at least two non-contact sensing circuits, with each of the non-contact sensing circuits having been provided with a sensing receiver, the sensing receiver tracks and senses an action of a user in a real time manner, with respect to each action made by the user, the sensing receiver outputs one sensing signal and sends out this sensing signal to the calculation and control module, and the calculation and control module then sends out a corresponding control signal based on a determination of the combination of received a plurality of sensing signals. On the other hand, the non-contact sensing circuit is selected from the group consisting of photo-sensitive sensing circuit, magnetic sensing circuit, thermal sensing circuit, sound sensing circuit and a combination of two or more of the foregoing.

In the present invention, the sensing control system has been provided with a calculation and control module. Through the calculation and control module, it is able to count the number of sensing events received by the signal detection module. Subsequently, based on the result from a comparison between the number of sensing events obtained from the foregoing counting and the data previously stored in the calculation and control module, a control signal that corresponds to the obtained number of sensing events is further sent out to an electric driving module, and eventually, the electric driving module sends out a driving signal to control the electric toy to act. As a result, based on different number of sensing events, the electric toy is capable of performing different actions or allowing one action to have changes in its speed. In this way, the present invention is able to make an electric toy that has been equipped with the sensing control system disclosed in the present invention to go beyond the limitation of a remote control, and thus becomes suitable as a toy for children of different ages. In addition, it makes a toy gain the advantages of becoming more user friendly, more interactive, more interesting, and thus would become many children's favorite. On the other hand, the sending control system may be provided with at least two non-contact sensing circuits, and each of the non-contact sensing circuits is provided with a sensing receiver. As a result, for each action or movement made by a user, the respective sensing receiver would output a corresponding sensing signal, and send out the foregoing sensing signal to the calculation and control module; and the calculation and control module accordingly sends out a corresponding control signal based on a determination of the received combination of a plurality of sensing signals. In this way, a user can have more different ways to play the electric toy. For example, a user can control the electric toy to move forward and backward, to turn to its left side or right side. In addition, by virtue of different signal combinations, the electric toy can gain more functions, such as prevention of trample and many other new functions, and make the operation become more flexible and easier to control. In addition, as disclosed previously, the non-contact sensing circuits of a toy may be selected from the group consisting of photo-sensitive sensing circuit, magnetic sensing circuit, thermal sensing circuit, sound sensing circuit and a combination of two or more of the foregoing. In this way, different sensing circuits may be employed together to control different functions of the same electric toy. In this way, the operability and enjoyability of the electric toy has been effectively improved.

The present invention will be further described in combination with the accompanying drawings and embodiments.

DETAILED DESCRIPTION OF THE DRAWINGS

Figure 1:
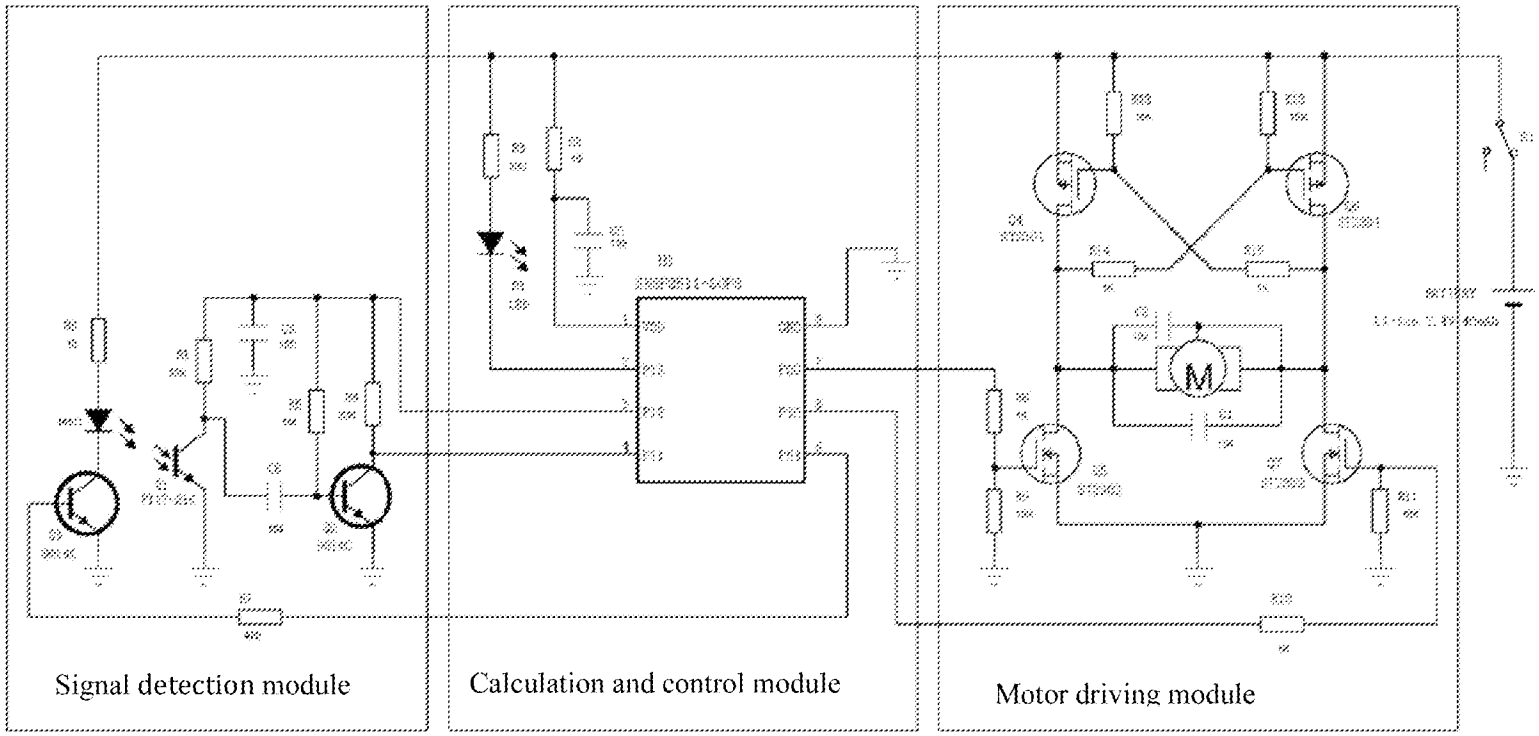
FIG. 1 is a schematic view of the circuit of an embodiment of the present invention.
Figure 2:
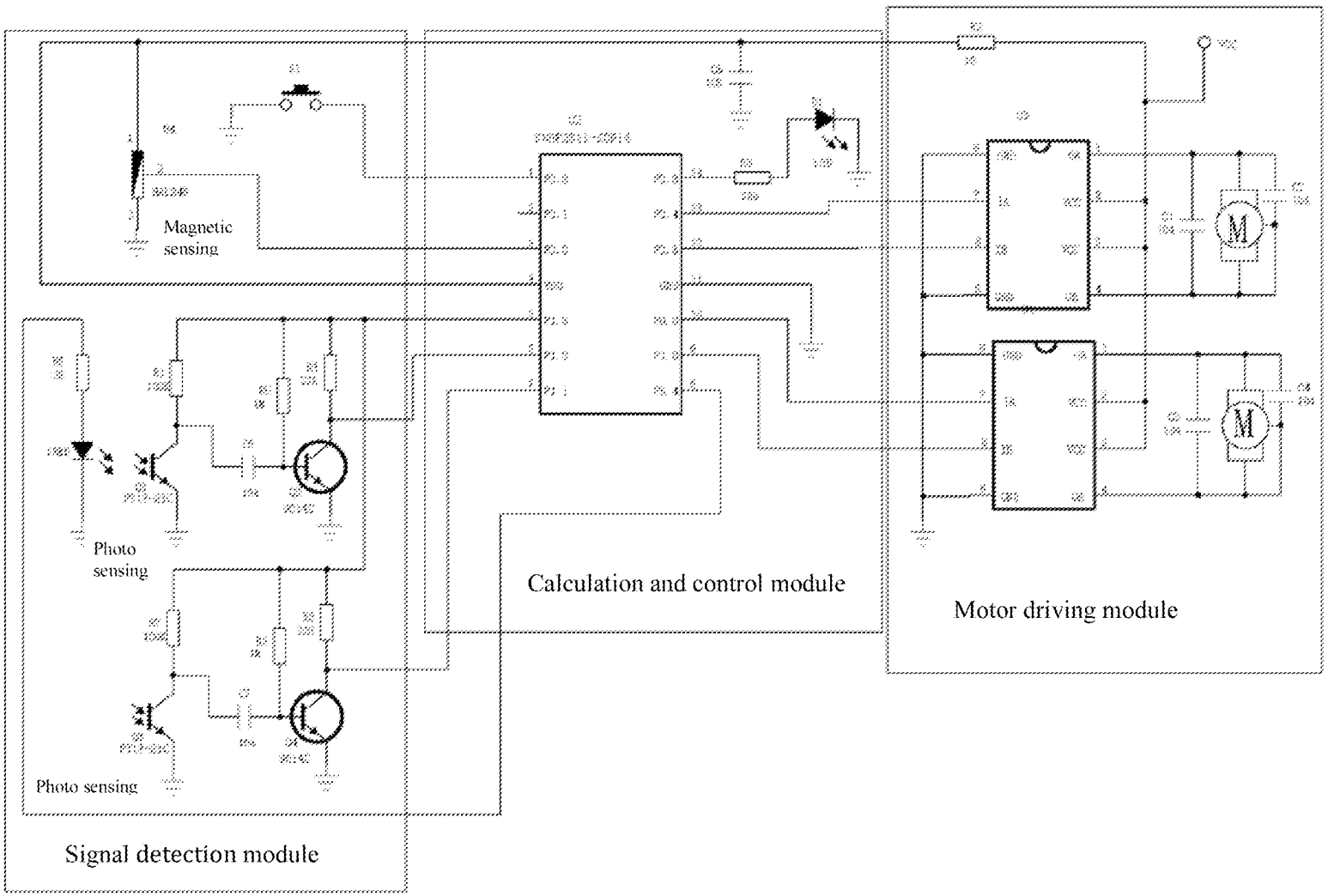
FIG. 2 is a schematic view of the circuit of another embodiment of the present invention.

As shown in FIG. 1 and FIG. 2, the present invention is a sensing control system for an electric toy, comprising: a signal detection module for receiving an external sensing and then generating a sensing signal; a calculation and control module for receiving the sensing signal and counting a number of the sensing signal, and then sending out different control signals corresponding to different numbers of the sensing signals; as well as an electric driving module for receiving the control signal and then sending a driving signal to the electric toy, so as to control the electric toy to work. In addition, through the calculation and control module, it is able to count the number of sensing signals received by the signal detection module. Subsequently, based on the result from a comparison between the number of sensing events obtained from the foregoing counting and the data previously stored in the calculation and control module, a control signal that is corresponding to the obtained number of sensing events is further sent out to the electric driving module, and eventually, the electric driving module sends out a driving signal to control the electric toy. As a result, based on different number of sensing events, the electric toy is capable of performing different actions or allowing one action to have changes in its speed. In this way, the present invention is able to make an electric toy that has been equipped with the sensing control system disclosed in the present invention go beyond the limitation of a remote control, and thus becomes suitable as a toy for children of different ages. In addition, it makes a toy gain advantages of becoming more user friendly, more interactive, more interesting, and thus would become many children's favorite.

DETAILED DESCRIPTION

Embodiment 1

As shown in FIG. 1, in this embodiment, the signal detection module comprises a non-contact sensing circuit, and the non-contact sensing circuit is a photo-sensitive sensing circuit, which corresponds to a sensing receiver that is a phototransistor. In addition, in this embodiment, it is also provided with an emission source. The phototransistor and the emission source have been arranged on the top of an electric toy car, so as to allow them to be able to track and sense the hand waving action of a user in a real time manner. Accordingly, when a user waves his or her hand once above the electric toy car, the sensing receiver correspondingly outputs a sensing signal, and then sends out the sensing signal to the calculation and control module. In addition, the calculation and control module is provided with a single chip microcomputer (SCM). The SN8P2511-SOP8 single chip microcomputer (SCM) has been employed in the present invention. This SCM is able to record the number of the sensing signal sent out from the above mentioned photosensitive sensing receiver in a continuous time period, as well as according to the recorded number of sensing signal to send out a control signal that is corresponding to the recorded number of sensing signal to the electric driving module. Moreover, the SCM has been stored of five sets of control signals, wherein each set of control signal is corresponding to a respective range of number. In the case that the recorded number is not within any one of the ranges of number, no signal is sent out; while in the case that the recorded number is within one of the ranges of number, send out the control signal that is corresponding to the range of number within which the recorded number of sensing signal is. Furthermore, the calculation and control module is also provided with an LED light. The LED light is able to flash according to the speed of a user's hand waving action. In this embodiment, the electric driving module is an electric driving module containing a motor, which has been arranged in the electric toy car. The control signal sent out from the SCM is used to control the motor's operation.

The specific control signals stored in the single chip microcomputer (SCM) in this embodiment are as follows: $\hat{1}$ waving hand 4 to 6 times, 1 second after completion of the foregoing waving action the electric car moving forward for 1 second, and the moving speed being 30% of a full running speed of the motor; $\hat{2}$ waving hand 7 to 9 times, 1 second after completion of the foregoing waving action the electric car moving forward for 2 seconds, and the moving speed being 45% of a full running speed of the motor; $\hat{3}$ waving hand 10 to 14 times, 1 second after completion of the foregoing waving action the electric car moving forward for 4 seconds, and the moving speed being 60% of a full running speed of the motor; $\hat{4}$ waving hand 15 to 20 times, second after completion of the foregoing waving action the electric car moving forward for 8 seconds, and the moving speed being 80% of a full running speed of the motor; and $\hat{5}$ waving hand more than 21 times, second after completion of the foregoing waving action the electric car moving forward for 12 seconds, and the moving speed being 100% of a full running speed of the motor.

In the case that the sensing control system described in this embodiment is used in an electric toy car, the operation procedure accordingly is as follows: press the power button, the system starts to work and the electric toy car is in a standby state at this moment, when a user waves his or her hand above the electric toy car and the waving action meets the requirement that the time interval between two consecutive hand waving actions is no more than 1 second, if the number of hand waving action is no more than 3 times within a time period of 4 seconds, the electric toy car does not respond and thus remains in the standby state to wait for future sensing; if the number of hand waving action is more than 4 times within a continuous time period, according to the respective control signal from the SCM, the user is able to control the electric toy car to move. For example, in the case that the user waves his or her hand 5 times, 1 second after completion of the foregoing waving action, the electric car moves forward for 1 second at the moving speed that is 30% of a full running speed of the motor; in the case that the user waves his or her hand 10 times, 1 second after completion of the foregoing waving action, the electric car moves forward for 4 seconds at the moving speed that is 60% of a full running speed of the motor; and in another case that the user waves his or her hand 25 times, 1 second after completion of the foregoing waving action, the electric car moves forward for seconds at the moving speed that is 100% of a full running speed of the motor. Further, after finishing one moving forward action, the electric toy car returns to the standby state, and in the case that a hand waving action is sensed within the next 5 minutes, the electric toy car runs again according to the respective number of hand waving actions. On the other hand, if no any hand waving action has been sensed within the next 5 minutes, the electric toy car then goes into an off state. In this case, a user needs to press the power button again to turn on the electric car back into a play state. Moreover, if a user needs to shut down the toy car manually, the user may achieve it by pressing the power button for 2 to 3 seconds.

Embodiment 2

As shown in FIG. 2, in this embodiment, the signal detection module comprises three non-contact sensing circuits, and each of the three non-contact sensing circuits has been provided of a sensing receiver, wherein two of the three non-contact sensing circuits are photo-sensitive sensing circuits, with their corresponding sensing receivers as phototransistors; and the third non-contact sensing circuit is a magnetic sensing circuit, with its corresponding sensing receiver as a magnetic sensing circuit. In this embodiment, the two phototransistors are able to track and sense the hand waving action from a user in a real time manner. On the other hand, the magnetic sensing element can only sense when a user is making a hand waving action with a magnetic article in his or her hand. When a user waves his or her hand once, the sensing receiver that is capable of sensing will correspondingly output a sensing signal, and then send out the sensing signal to the calculation and control module. The calculation and control module controls the moving direction of the electric toy by means of determining the specific sequence of the generated sensing signals. The calculation and control module has been provided with an SN8P2511-SOP14 single chip microcomputer (SCM). The single chip microcomputer (SCM) is able to record the respective number of sensing signals sent out from the above mentioned three sensing receivers in a continuous time period, as well as according to the recorded number to send out a control signal that is corresponding to the recorded number to the electric driving module. Similarly, the SCM has been stored with multiple sets of control signals, in which each set of control signal is corresponding to a respective range of number. In the case that the recorded number is not within any one of the ranges of the number, no signal is sent out; while in the case that the recorded number is within one of the ranges of the number, send out the control signal that corresponds to the range of the number within which the recorded number is. And similarly, the calculation and control module is also provided with an LED light. The LED light is able to flash according to the speed of a user's hand waving action. In this embodiment, the electric driving module is an electric driving module containing a motor, which has been arranged in the electric toy car. The control signal sent out from the SCM is used to control the motor's operation.

In this embodiment, the above mentioned two phototransistors are disposed on the top of an electric toy car and in a front to rear arrangement. The magnetic element is disposed on one side of the two phototransistors. When a user makes a hand waving action from rear side toward front side of the electric toy car with an empty hand, the phototransistor located on the rear side of the toy car senses the waving action first and accordingly sends out a sensing signal, and then the phototransistor located on the front side of the toy car senses the waving action next and accordingly sends out a sensing signal as well. As for the magnetic element, it is not able to sense the waving action with an empty hand and accordingly does not send out any magnetic sensing signal in this situation. The SCM first determines the sequence in which the two sensing signals have been generated as well as the number of the waving actions made by the user in a continuous time period, and accordingly, controls the electric toy car to move forward at a speed corresponding to the number of sensed waving actions. In the case when a user makes a hand waving action from front side toward rear side of the electric toy car with an empty hand, the phototransistor located on the front side of the toy car senses the waving action first and accordingly sends out a sensing signal, and then the phototransistor located on the rear side of the toy car senses the waving action next and accordingly sends out a sensing signal as well. As for the magnetic element, it is not able to sense the waving action with an empty hand and accordingly does not send out any magnetic sensing signal. The SCM first determines the sequence in which the two sensing signals have been generated as well as the number of the waving actions made by the user in a continuous time period, and accordingly, controls the electric toy car to move backward at a speed corresponding to the number of sensed waving actions. In another case, when a user makes a hand waving action above the electric toy car with a magnetic article in hand, the two phototransistors sensing the hand waving action sequentially and accordingly send out respective sensing signals, in addition, because of the magnetic article, the magnetic sensing element will send out a magnetic signal in this case. The SCM first determines the sequence in which the two sensing signals have been generated as well as the number of the waving actions made by the user in a continuous time period, and accordingly, controls the electric toy car to move forward or backward at a speed corresponding to the number of hand waving actions. And at the same time, the SCM receives the magnetic sensing signal sent form the magnetic sensing circuit and accordingly sends out a corresponding instruction to control certain other functions of the electric toy car. More specifically, in this embodiment, when the SCM receives the magnetic sensing signal, it will further control to increase running speed of the motor in the electric toy car. That is to say, with the same number of hand waving actions, when a user makes the hand waving actions with a magnetic article in the user' hand, the electric toy car would move faster than that when the user makes hand waving actions with an empty hand.

Although the present invention has been described in reference to the specific embodiments described above, the description of embodiments does not intend to limit the present invention. On the basis of the description of the present invention, a person of ordinary skill in the art is able to anticipate other changes for the disclosed embodiments. Therefore, these changes are within the scope defined by the claims of the present application.

What is claimed:

1. A sensing control system for an electric toy, comprising:

a signal detection module for receiving an external signal and then generating a sensing signal;

a calculation and control module for receiving the sensing signal and counting a number of the sensing signal, and then sending out different control signals corresponding to different numbers of the sensing signals; and an electric driving module for receiving the control signal and then sending a driving signal to the electric toy, so as to control the electric toy to work;

wherein the electric driving module is a motor driving module comprising a motor, the calculation and control module is provided with a single chip microcomputer, the single chip microcomputer is stored with the control signals as follows: when a range of the number is $N_1$, the motor runs at a speed of $S_1$ for $T_1$ seconds; when a range of the number is $N_2$, the motor runs at a speed of $S_2$ for $T_2$ seconds; and when a range of the number is $N_3$, the motor runs at a speed of $S_3$ for $T_3$ seconds; and so forth, when a range of the number is $N_m$, the motor runs at a speed of $S_m$ for $T_m$ seconds; wherein $N_1<N_2<N_3<N_m$, $S_1<S_2<S_3<S_m$, and $T_1<T_2<T_3<T_m$, wherein the signal detection module is a photo-sensitive sensing module that comprises a phototransistor, the phototransistor is arranged on an upper surface of the electric toy, when a user waves his or her hand above the electric toy, the phototransistor receives a signal and accordingly sends out a sensing signal to the calculation and control module, in the case that the user waves his or her hand for X times in a continuous time period and with a time interval between two consecutive waving actions being no longer than 1 second, 1 second after a termination of the waving action of the user, the single chip microcomputer is programmed to count the generated sensing signal and reaches a counting number X, and then respectively compares the number X with $N_1$, $N_2$, $N_3$ . . . $N_m$, if X is smaller than $N_1$, no signal is sent out, if X is within one of $N_2$, $N_3$ . . . $N_m$, sends out the control signal corresponding to the range of the number within which X is to the electric driving module, which further drives the motor to run according to the specified running speed and the specified running time corresponding to that control signal.

2. The sensing control system for an electric toy as claimed in claim 1, wherein the signal detection module comprises a non-contact sensing circuit, the non-contact sensing circuit is provided with a sensing receiver, the sensing receiver tracks and senses an action of a user in a real time manner, with respect to each action made by the user, the sensing receiver outputs one sensing signal and sends out the sensing signal to the calculation and control module.

3. The sensing control system for an electric toy as claimed in claim 2, wherein the non-contact sensing circuit is selected from the group consisting of photo-sensitive sensing circuit, magnetic sensing circuit, thermal sensing circuit and sound sensing circuit.

4. The sensing control system for an electric toy as claimed in claim 1, wherein the calculation and control module comprises a control chip, the control chip records the number of the sensing signal sent out from the signal detection module in a continuous time period, and according to the recorded number sends out a control signal that is corresponding to the recorded number to the electric driving module.

5. The sensing control system for an electric toy as claimed in claim 4, wherein the control chip is stored with a plurality sets of control signals, wherein each set of control signal is corresponding to a range of the number, in the case that the recorded number is not within any one of the ranges of the number, no signal is sent out, while in the case that the recorded number is within one of the ranges of the number, send out the control signal that is corresponding to the range of the number within which the recorded number is.

6. The sensing control system for an electric toy as claimed in claim 1, wherein the signal detection module comprises at least two non-contact sensing circuits, and each of the non-contact sensing circuits is provided with a sensing receiver, the sensing receiver tracks and senses an action of a user in a real time manner, with respect to each action made by the user, the sensing receiver outputs one sensing signal and sends out the sensing signal to the calculation and control module, and the calculation and control module then sends out a corresponding control signal based on a determination of the received combination of a plurality of sensing signals.

7. The sensing control system for an electric toy as claimed in claim 6, wherein the non-contact sensing circuit is selected from the group consisting of photo-sensitive sensing circuit, magnetic sensing circuit, thermal sensing circuit, sound sensing circuit and a combination of two or more of the foregoing.

* * * * *